US005611917A

United States Patent [19]

Degner

[11] Patent Number: 5,611,917

[45] Date of Patent: Mar. 18, 1997

[54] FLOTATION CELL CROWDER DEVICE

[75] Inventor: Vernon R. Degner, Colsax, Calif.

[73] Assignee: Baker Hughes Incorporated, Houston, Tex.

[21] Appl. No.: 552,008

[22] Filed: Nov. 2, 1995

[51] Int. Cl.[6] ..... B03D 1/14; B03D 1/16

[52] U.S. Cl. ..... 209/168; 209/169

[58] Field of Search ..... 209/168, 169, 209/170; 210/221.2

[56] References Cited

U.S. PATENT DOCUMENTS

| | | |
|---|---|---|
| 1,314,316 | 8/1919 | Flinn . |
| 2,061,564 | 11/1936 | Drake . |
| 2,182,442 | 12/1939 | Booth . |
| 2,269,583 | 1/1942 | Dromgold . |
| 2,369,401 | 2/1945 | Morash . |
| 3,032,199 | 5/1962 | Sumiya . |
| 3,993,563 | 11/1976 | Degner . |
| 4,668,382 | 5/1987 | Jameson . |
| 4,737,272 | 4/1988 | Szatkowski et al. . |
| 5,039,400 | 8/1991 | Kallioinen . |
| 5,219,467 | 6/1993 | Nyman et al. . |
| 5,251,764 | 10/1993 | Niitti . |

FOREIGN PATENT DOCUMENTS

| | | |
|---|---|---|
| 2281521 | 3/1995 | United Kingdom . |

OTHER PUBLICATIONS

T.A. Lloyd; "Advances in Flotation Technology: Tank Cells Revisited"; Society for Mining, Metallurgy, and Exploration, Inc.; 1993; pp. 1–4.

K. Heiskanen et al.; "Individual Operation and Control of a Large 100 $M^3$ Flotation Cell"; vol. II Flotation; IV Meeting of the Southern Hemisphere on Mineral Technology; and III Latin American Congress on Froth Flotation; 1994; pp. 501–515.

J. Kallioinen et al.; "Large Flotation Cell Tests Successful in Chile"; Mining Engineering; Oct. 1995; pp. 913–915.

*Primary Examiner*—Thomas M. Lithgow
*Attorney, Agent, or Firm*—Trask, Britt & Rossa

[57] ABSTRACT

A froth crowder device is disclosed for incorporation into a froth flotation cell to improve the froth removal dynamics of the flotation cell. The froth crowder device is positioned within a froth flotation cell above and below the overflow launder, and provides a sloped surface to direct froth toward the overflow launder in an expedited manner. Experimental data confirms that use of a froth crowder device as disclosed expedites movement of the froth toward the launder for more efficient operation, permits operating the rotor of the flotation cell at reduced speeds without compromising the efficiency of operation, and reduces the amount of air necessary to produce a froth in the cell. Experimental data also confirms that little or no surface eddies are observed in froth flotation cells in which a crowder device as disclosed is used. By comparison, flotation cells without use of a crowder device experience increased occurrences of surface eddies which traps the froth within the tank and extends froth residency time to the ultimate detriment of separation efficiency.

10 Claims, 4 Drawing Sheets

FLOTATION CELL CROWDER DEVICE

BACKGROUND

1. Field of the Invention

This invention relates to froth flotation cells which are used to beneficiate mineral ores by separating selected value specie components from a composite. Specifically, this invention relates to structural means for improving froth removal dynamics in flotation cells.

2. Statement of the Art

Froth flotation cells are widely known and used in a variety of industries to preferentially separate particulates or other suspendable species from each other thereby upgrading the product grade. Flotation cells are most commonly used in metallurgical and mining operations, but are used in many other industries. Selective solids separation in a flotation cell is accomplished by mixing air (bubbles) with suitably prepared mineral in fluid to facilitate attachment of a floatable specie to an air bubble which then rises to the top of the fluid volume for removal at or near the top of the tank. Froth is produced by the introduction of air into the fluid or slurry with the resulting attachment of selected particles to the air bubbles produced. The air bubbles, with floatable particles attached, float to the top of the fluid volume the tank and produce a layer or phase of froth which contains the floatable specie. The froth is then removed via an overflow weir positioned near the top of the fluid volume. Froth may also be produced or enhanced by the addition of frothing agents.

Flotation cell technology has focussed on various aspects of froth flotation mechanics in an effort to optimize methods and efficiencies of separation. All flotation cells generally comprise the same principal elements, namely a tank sized for retaining a volume of fluid, an inlet or influent feed source, a means of introducing air or another gas into the fluid volume, and an overflow weir near the top of the tank to receive the froth formed on the fluid volume. Typically, flotation cells will include an underflow conduit or other outlet to remove fluids and non-floatable separated solids near the bottom of the cell or tank.

In operation of a flotation cell, an influent feed is introduced into the tank, usually at or near the bottom of the tank. A stator-rotor structure is centrally positioned in the tank relative to the vertical axis of the tank when viewed in a plan view. Air is introduced into the flotation cell, either under pressure (i.e., forced air) or by natural ingestion of air by action of the rotor mechanism. Air bubbles are generated in the volume of circulated pulp within the tank and is mixed with the minerals therein. A stable air bubble matrix is formed where particles in the influent contact or adhere to the bubbles. The air bubbles rise to the top of the fluid volume and form a froth which flows into a launder positioned near the top of the tank. Examples of flotation cells comprising the basic elements and operations described are disclosed in U.S. Pat. No. 3,993,563 to Degner issued Nov. 23, 1976 and U.S. Pat. No. 4,737,272 to Szatkowski, et al., issued Apr. 12, 1988.

Modifications of the above-described basic elements of a flotation cell have been developed in an effort to maximize operation of the flotation cell, usually responsive to varying conditions in the influent feed or variations in the type or size of particulates contained in the influent. For example, U.S. Pat. No. 5,219,467 to Nyman, et al., discloses a modified flotation cell structured to provide increased agitation to the influent feed in order to improve selectivity of species in the separation process. The structure of the flotation cell includes means for introducing air into the bottom of the tank and shearing it to form bubbles which are then directed upwardly along the circumference of the tank by vertical flow guides. An agitation attenuator is positioned in the mid-section of the flotation cell to reduce the agitation process and to move flotation air to the outer circumference of the flotation cell.

Another example of a modified flotation cell which is structured to introduce wash water into the froth to remove interstitially entrapped gangue is disclosed in UK Patent Application No. 2 281 521, published Mar. 8, 1995. The disclosed flotation cell is structured with a porous diffusion surface positioned below the top of the tank which directs froth upwardly in the tank and introduces wash water to the upper portion of the froth. In a similar construction, U.S. Pat. No. 5,039,400, issued Aug. 13, 1991, discloses a modified flotation cell which is structured to reduce the area in which froth is formed to intentionally deepen, or extend the height of, the froth bed and thereby increase the residence time of the froth within the tank. A source of wash water is positioned within the froth bed to wash away impurities trapped in the froth.

The flotation cells described above, as well as many other flotation cell designs, are designed to optimize operation of the apparatus responsive to requirements of the influent feed liquid and the particulate matter profiles. Known flotation cell constructions heretofore have neither appreciated nor addressed the operational benefits which can be gained by providing a means for expediting removal of the froth from the flotation cell. Thus, it would be advantageous in the art to provide a flotation cell which is structured to facilitate removal of the froth from the flotation cell tank and thereby enhance the operation of the apparatus.

SUMMARY OF THE INVENTION

In accordance with the present invention, a crowder device for placement in a flotation cell is structured to facilitate and expedite movement of froth out of the flotation cell via an overflow weir. The crowder device of the present invention is further structured to reduce the amount of air required in the system to produce froth with the consequential reduction in the amount of energy required to power the rotor of the flotation cell. The crowder device of the present invention may be used in a flotation cell for any number or type of uses, but is described herein in terms of use in a flotation cell for metallurgical separation applications.

The crowder device is a three-dimensional structure having an upper perimeter edge, a lower perimeter edge and a substantially continuous contact surface extending between the upper perimeter edge and the lower perimeter edge. The upper perimeter edge is of greater dimension than the lower perimeter edge such that the substantially continuous contact surface therebetween is downwardly and inwardly sloped, at a selected angle, from the upper perimeter edge to the lower perimeter edge. The crowder device may be, therefore, a truncated conical shape, a truncated trapezoidal shape, a multifaceted conical shape of generally a multi-planar circular cross section (e.g., pentagonal, hexagonal, octagonal, etc.), or any other appropriate and suitable shape.

The crowder device is designed for placement in a flotation cell which generally comprises a tank having sides and a bottom, an influent feed inlet, an overflow weir or launder, an outlet for drainage of fluid from the tank, a rotor assembly, and means which provide for introducing or entraining air by natural ingestion into the fluid volume contained within the tank of the flotation cell. The crowder device, therefore, includes means for attachment to either the rotor assembly or to the tank, or both.

The crowder device is positioned within the flotation cell above the rotor or impeller blades of the rotor assembly. The crowder device is positioned to extend a distance above the overflow weir or launder. In most flotation cells, the overflow weir or launder is positioned at or near the top of the tank, and in such flotation cells the crowder device is positioned to extend in part above the upper edge of the tank. The crowder device is positioned relative to the rotor and the overflow weir to direct the flow of froth toward the overflow weir or launder to encourage expedited removal of the froth. The contact surface of the crowder device is sloped or angled downwardly and inwardly toward the central vertical axis of the tank at between about a 35° to about a 45° angle to a horizontal plane transverse to the vertical axis of the tank.

In one embodiment, the position of the crowder device relative to the vertical axis of the tank may be adjustable such that the distance between the upper edge of the crowder device and the overflow weir lip may tie increased or decreased. Whether vertically adjustable or stationary, the distance between the upper edge of the crowder device and the overflow weir lip is between about 6% to about 11% of the depth of the tank. As a result, emphasis is placed on encouraging movement of the froth out of the tank rather than on developing a thick froth bed with extended froth residency.

The crowder device is structured to provide a sufficiently sloped contact surface above the fluid line in the flotation cell tank to facilitate movement of the froth toward the launder. As froth is produced above the fluid volume contained within the tank, the froth contacts the crowder device and is encouraged to move up and out toward the overflow weir for removal. Experimental test data demonstrates that more rapid movement of the froth toward the overflow weir, and increased removal of the froth by purposefully directing the froth to the overflow weir, decreases the amount of energy necessary to operate the rotor. That is, experimental data demonstrates that the rotor can be operated at a lower speed while still introducing or entraining a sufficient amount of air to produce a productive froth within the tank. However, because the amount of air required to produce a productive froth is reduced, the rotor may be efficiently operated with less energy. Experimental data also demonstrates that the design of the crowder device eliminates surface eddies which contribute to increased froth residency within the tank and to inefficient operation.

BRIEF DESCRIPTION OF THE DRAWING

In the drawing, which illustrates what is currently considered to be the best Mode for carrying out the invention.

DETAILED DESCRIPTION OF THE PREFERRED EMBODIMENTS

Figure 1:
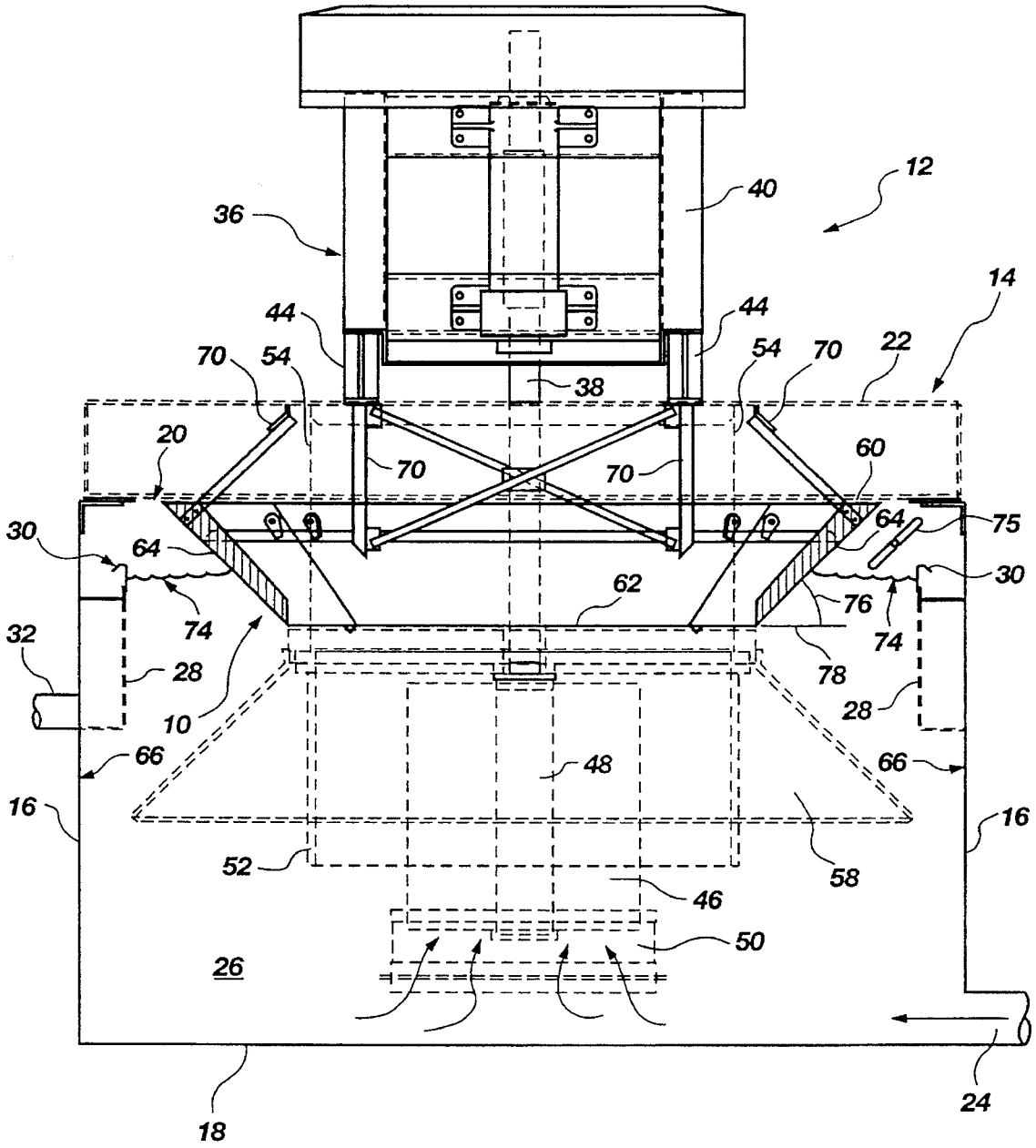
FIG. 1 is an elevational view in cross section of a flotation cell in which the crowder device of the invention is installed.

The crowder device of the present invention may be installed in virtually any type of natural ingestion flotation cell. However, for the purposes of illustration only, the crowder device 10 is illustrated in FIG. 1 as installed in a froth flotation cell 12 of the type described and illustrated in U.S. Pat. No. 3,993,563, the contents of which are incorporated herein by reference, with some modifications which are described further hereinafter. The flotation cell 12 illustrated in FIG. 1 comprises a tank 14 having continuous sides 16 and a bottom 18. The tank 14 may be constructed with one continuous side or wall (i.e., a circular tank) or with four or more sides 16 thereby having a geometrical cross-section, such as a square, rectangle, hexagon, etc. The upper section or top 20 of the tank 14 may be open, but in some applications it may be closed by a cover 22 as illustrated. An influent feed inlet 24 is associated with the tank 14 to direct influent feed into the tank 14. In one embodiment as shown, the influent feed inlet 24 may be a pipe positioned near the bottom 26 of the tank 14 and may be structured to introduce influent feed into the bottom 26 of the tank 14, as illustrated by the arrows. Other means of introducing influent feed are suitable. The tank 14 is also structured with an overflow weir or launder 28 positioned near the upper section or top 20 of the tank 14. The launder 28 may include an overflow lip 30 to facilitate movement of froth into the launder 28. An outlet 32 is in fluid communication with the launder 28 to transport froth away from the launder 28.

A rotor system 36 is associated with the tank 14 for agitating the influent feed entering the tank 14 and to process air or gas for the formation of bubbles. One example of a rotor system 36 is illustrated in FIG. 1. The rotor system 36 includes a centrally located and vertically oriented rotatable drive shaft 38 which extends above the top 20 of the tank 14 as well as into the interior of the tank 14. The rotor system 36 is positioned above the bottom 26 of the tank 14. The rotatable drive shaft 38 is attached to a bearing assembly 40 which includes a drive motor (not shown). The bearing assembly 40 is attached to the top 20 of the tank 14, or, as illustrated, is mounted to the cover 22 by mounting bracket means 44. Attached to the lower end of the rotatable drive shaft 38 is a rotor or impeller 46 which is in turn attached to an impeller hub 48. Although not shown in detail in FIG. 1, the impeller 46 may be of conventional construction having a plurality of vanes radiating outwardly from the impeller hub 48. The impeller 46 is positioned above the bottom 26 of the tank 14.

In the particular embodiment illustrated in FIG. 1, a draft tube 50 is positioned near the bottom 26 of the tank 14 and is coaxially aligned with the rotatable drive shaft 38. The draft tube 50 is sized to encircle the impeller 46 without interfering with its rotation. The draft tube 50 directs influent feed upwardly toward the impeller 46. A draft tube 50 may not always be included in a flotation cell 12. The impeller 46 is also surrounded by a stationary assemblage including a fenestrated disperser 52 which is coaxially aligned with the rotatable drive shaft 38 and acts to facilitate shearing of air bubbles and to eliminate pulp vortexing within the vessel.

Above the disperser 52 is positioned a standpipe 54 which is also coaxially aligned with the rotatable drive shaft 38. Influent feed encountered by the impeller 46 forms a vortex which extends from approximately the impeller 46 into the standpipe 50. In the illustrated embodiment, the vortex creates an area of reduced pressure therein and air is entrained into the rotating vortex of fluid as a result. This is an example of a flotation cell 12 which has means for entraining air into the influent feed—a process which may be termed "natural ingestion." A perforated hood 58 is positioned over and about the disperser 52 to stabilize the pulp surface. The perforated hood 58 is used in the illustrated embodiment of the natural ingestion flotation cell 12 because the impeller 46 is positioned near the top of the fluid volume and the perforated hood 58 acts to calm the turbulent fluid.

The crowder device 10 of the present invention is positioned generally within the tank 14 and is coaxially aligned with the rotatable drive shaft 38. The crowder device 10 comprises a three-dimensional apparatus having an upper edge 60, a lower edge 62 and a sloping surface 64 extending between the upper edge 60 and the lower edge 62. The crowder device 10 is positioned generally above the impeller 46, and in the particular illustrated embodiment, is position above the perforated hood 58 surrounding the disperser 52. The crowder device 10 is secured to the flotation cell 12 in a manner which maintains the crowder device 10 in position. As illustrated, for example, the crowder device 10 may be attached to the cover 22 of the tank 14 by mounting bracket means 70. Alternatively, or in addition, the crowder device 10 may be attached to the standpipe 54, disperser 52, perforated hood 58 or sides 16 of the tank 14. In the embodiment shown in FIG. 1, the crowder device 10 is supported by the perforated hood 58. It may be suitable, in an alternative embodiment to secure the crowder device 10 to the perforated hood 58 point of attachment of the perforated hood 58 to the rotor system 36.

Many alternative means of securing the crowder device 10 to the flotation cell 12 are suitable and are within the skill in the art. It is only important that the crowder device 10 be secured to the flotation cell 12 in a manner to position the crowder device 10 partially above the level of the launder 28 or overflow lip 30 to assure positioning of the sloped surface 64 in a manner to urge movement of the froth along the sloped surface 64 toward the launder 28. It is also important that the crowder device 10 be attached in a manner to assure that the sloped surface 64 retains an appropriate selected angle of slope for facilitating movement of froth to the launder 28. Thus, the crowder device 10 is positioned such that the vertical distance between the upper edge 60 of the crowder device 10 and the overflow lip is between about 6% and about 11% of the overall depth of the tank 14, and the vertical distance between the lower edge 62 of the crowder device 10 and the overflow lip 30 is between about 5% and about 15% of the overall depth of the tank 14.

Figure 2A:
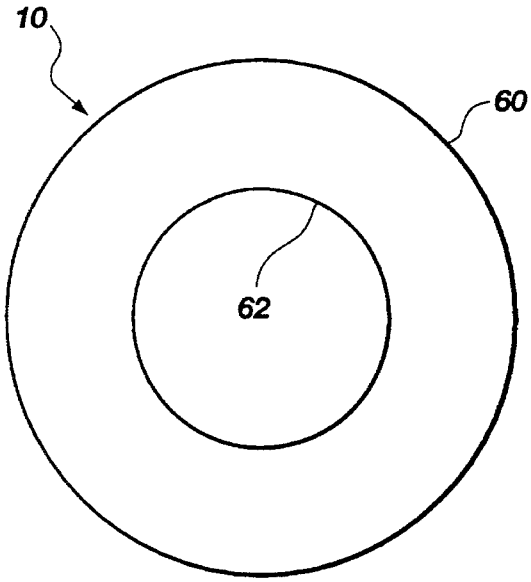
FIGS. 2 (a)–(c) are plan views of three different alternative configurations of the crowder device.
Figure 2B:
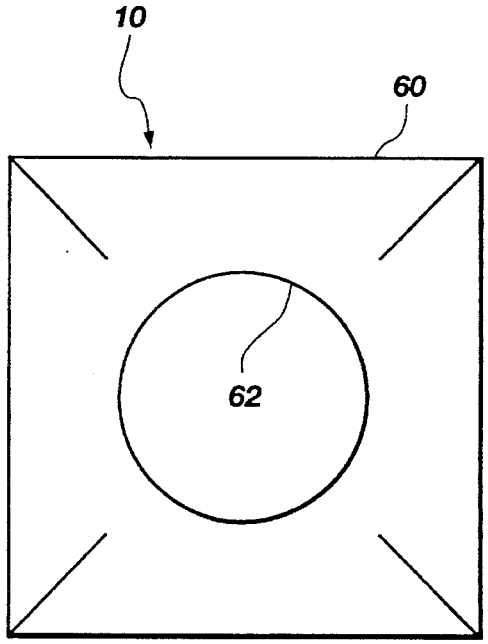
Figure 2C:
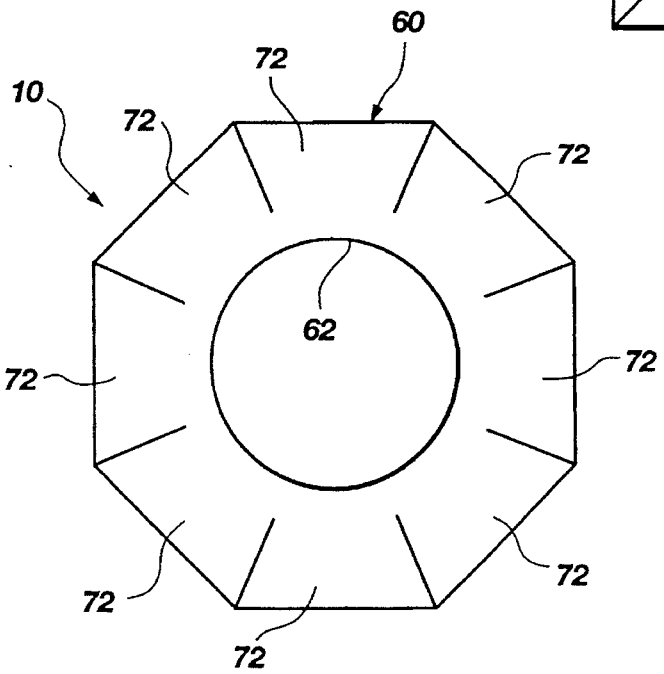

The crowder device 10 may have any suitable shape that provides a sloped surface 64 oriented toward the interior surface 66 of the tank 14, the slope angle of which facilitates movement of the froth to the launder 28, as explained further hereinafter. For example, the crowder device 10 may be configured to be circular in lateral cross section such that the crowder device 10 is formed as a truncated cone, shown in FIG. 2(*a*). The crowder device 10 illustrated in FIG. 1 is configured as a truncated cone. Alternatively, the crowder device 10 may be configured as a truncated pyramidal shape, as shown in FIG. 2(*b*). In other alternative embodiments, as suggested by FIG. 2(*c*), the crowder device 10 may comprise multifaceted planar sections 72 such that the crowder device 10 presents a geometrical profile (e.g., hexagonal) in lateral cross section. The crowder device 10 may be constructed of rigid material, such as metal, or may be constructed of a semi-rigid or moderately flexible material, such as rubber or plastic.

In operation of a flotation cell 12 into which has been incorporated a crowder device 10 as described herein, influent feed is introduced into the tank 14, most suitably near the bottom 26 of the tank 14. Fluid enters into the draft tube 50 where it impacts with the impeller 46. The blades of the impeller 46 agitate the fluid. Simultaneously, air is mixed with the fluid. In some flotation cell configurations, air may be introduced through a conduit (not shown) extending through the drive shaft 38, and air is introduced at or near the bottom of the impeller 46. In the flotation cell 12 illustrated in FIG. 1, air is entrained into the fluid by the establishment of a vortex of fluid in the standpipe 54 caused by the turning motion of the impeller 46. Air from the top of the tank 14 (i.e., air existing above the fluid line in the tank) is entrained into the vortex and, additionally, air may be introduced into the standpipe 54 by a pipe or tube (not shown).

As air is entrained into the swirling fluid, bubbles are formed which are sheared by the rotation of the impeller 46. The bubbles may be further sheared by movement of the fluid through the disperser 52. As the fluid and air is spun by action of the impeller 46, certain particulates or suspendable species will adhere to the small bubbles which rise to the fluid surface where the froth forms. Thus, the production of froth is well known to be useful not only in generally separating and removing particulates from a fluid or slurry, but for selectively removing certain value species from non-value species for recovery.

As the stable air-bubble matrix is formed, it moves toward the top of the fluid volume within the tank 14 where it forms a froth and floats on the liquid surface 74. In flotation cells which do not include a crowder, the froth eventually builds to the point where it rises above the edge of the launder and overflows into the launder for removal from the tank. In the flotation cell 12 described herein having a crowder device 10 as shown, the froth forming at the top of the liquid surface 74 comes into contact with the sloped surface 64 of the crowder device 10. Due to the angle of the sloped surface 64 and the vertical distance between the upper edge 60 of the crowder device and the overflow lip, the rising froth is immediately urged toward the launder 28 and is urged over the overflow lip 30. Optionally, skimmer paddles 75 may be located near the overflow lip 30 to aid in movement of the froth to the launder 28.

The speed at which the froth travels toward the launder 28 and exits over the overflow lip 30 is influenced by the angle or position of the sloped surface 64. Therefore, the angle 76 of the sloped surface 64, as measured from a horizontal plane 78 transverse the vertical drive shaft 38, is about 35° to about 45°. However, froth characteristics vary depending on the type of fluid or slurry which is being processed, and on the type or size of particulates being separated with the froth. The optimal speed at which a froth may be removed from the flotation cell 12 may be facilitated, therefore, by the ability to adjust the angle or vertical position of the sloped surface 64 responsive to the variability of the froth being formed.

Adjustability of the position of the sloped surface 64 is provided by the ability to move the crowder device 10 vertically relative to the launder 28 so that the upper edge 60 of the crowder device 10 is positioned closer to or farther from the launder 28. The crowder device 10 may be configured to be vertically adjustable relative to the flotation cell 12 by vertical adjustment means, such as may be provided by movement of the mounting bracket means 70. In the illustrated embodiment, therefore, the crowder device 10 may, for example, be vertically adjustable relative to the standpipe 54 by adjustment of the mounting bracket means 70. In an embodiment having vertical adjustability, the crowder device 10 may preferably be adjustable so that the vertical distance between the upper edge 60 of the crowder device 10 and the overflow lip 30 is adjustable to between about 6% and about 11% relative to the overall depth of the tank 14.

Adjustability of the angle 76 of the sloped surface 54 may be accomplished in a variety of ways. One exemplar method, illustrated in FIG. 1, is to provide mounting bracket means 70 which are longitudinally adjustable so that when adjusted in length, the upper edge 60 of the crowder device 10 is urged downwardly while the lower edge 62 of the crowder device 10 remains stationary, thereby adjusting the angle 76 of the sloped surface 64 to a smaller angle. Likewise, the length of the mounting bracket means 70 may be shortened to urge the upper edge 60 of the crowder device 10 upwardly while the lower edge 62 of the crowder device 10 remains stationary thereby adjusting the angle 76 of the sloped surface 64 to a greater degree. The adjustability of the angle 76 of the sloped surface 64 may be particularly facilitated by constructing the crowder device 10 of a relatively flexible material such as rubber or plastic.

Figure 3:
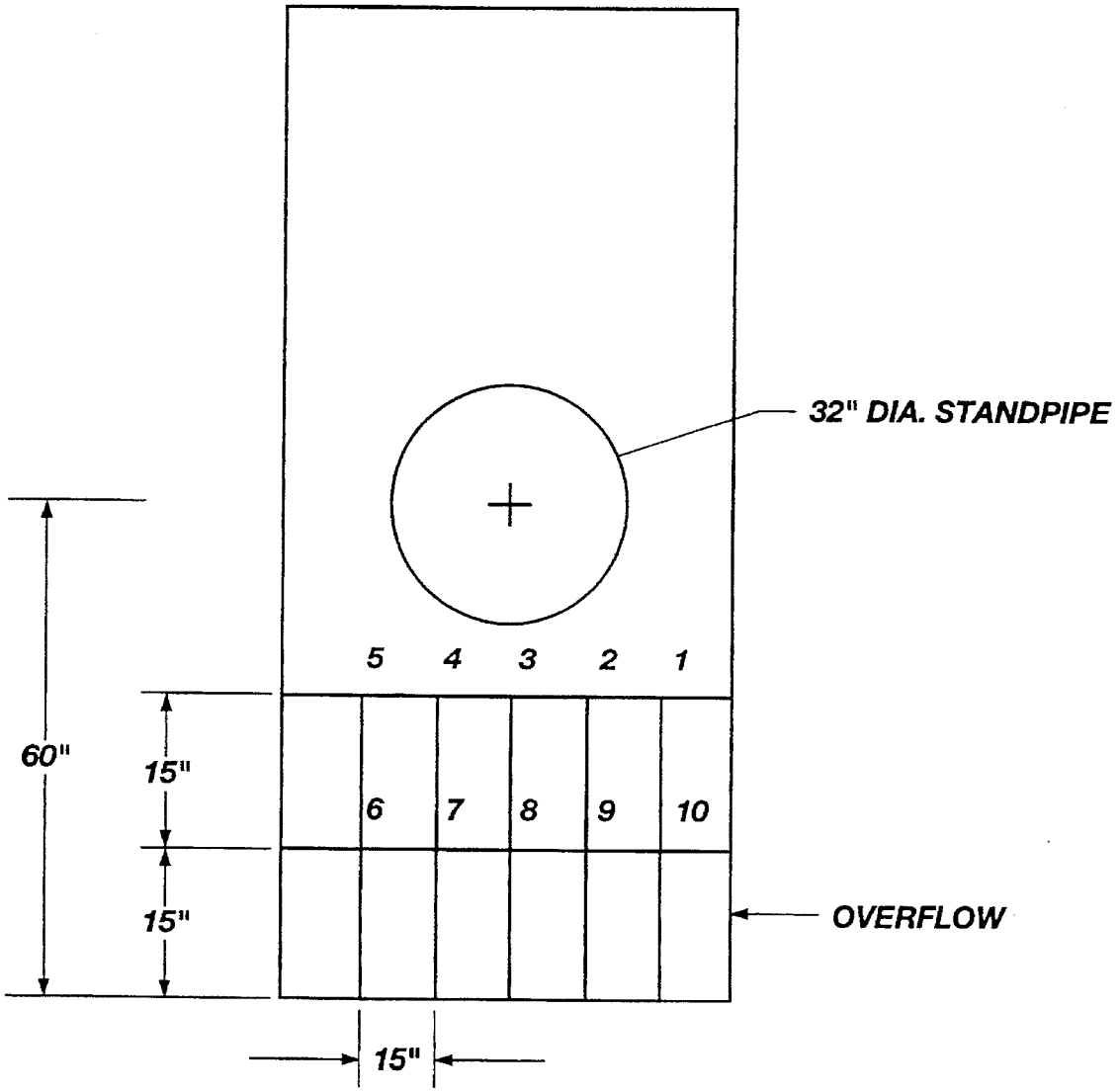
FIG. 3 is a schematic plan view of flotation cell without a crowder device used for comparative testing.

The advantages gained from use of the crowder device 10 described herein have been established through experimental tests in which a flotation cell of the type illustrated in FIG. 1, but lacking a crowder device, was compared with a flotation cell of the type shown in FIG. 1 in which a crowder device was installed. Each flotation cell had a 300 cubic foot capacity rectangular-shaped tank with a standard twenty-two (22) inch diameter impeller (i.e., rotor) positioned twelve inches below the fluid line of the fluid volume in the tank. The crowder device in the one flotation cell was adjusted to a 45° angle and was positioned so that the upper edge (60) of the crowder device was positioned twenty-five inches from the launder (28) (designated in FIGS. 3 and 4 as "overflow"). A schematic plan view of the test flotation cell without a crowder device is shown in FIG. 3. A schematic plan view of the test flotation cell with a crowder device is shown in FIG. 4.

Figure 4:
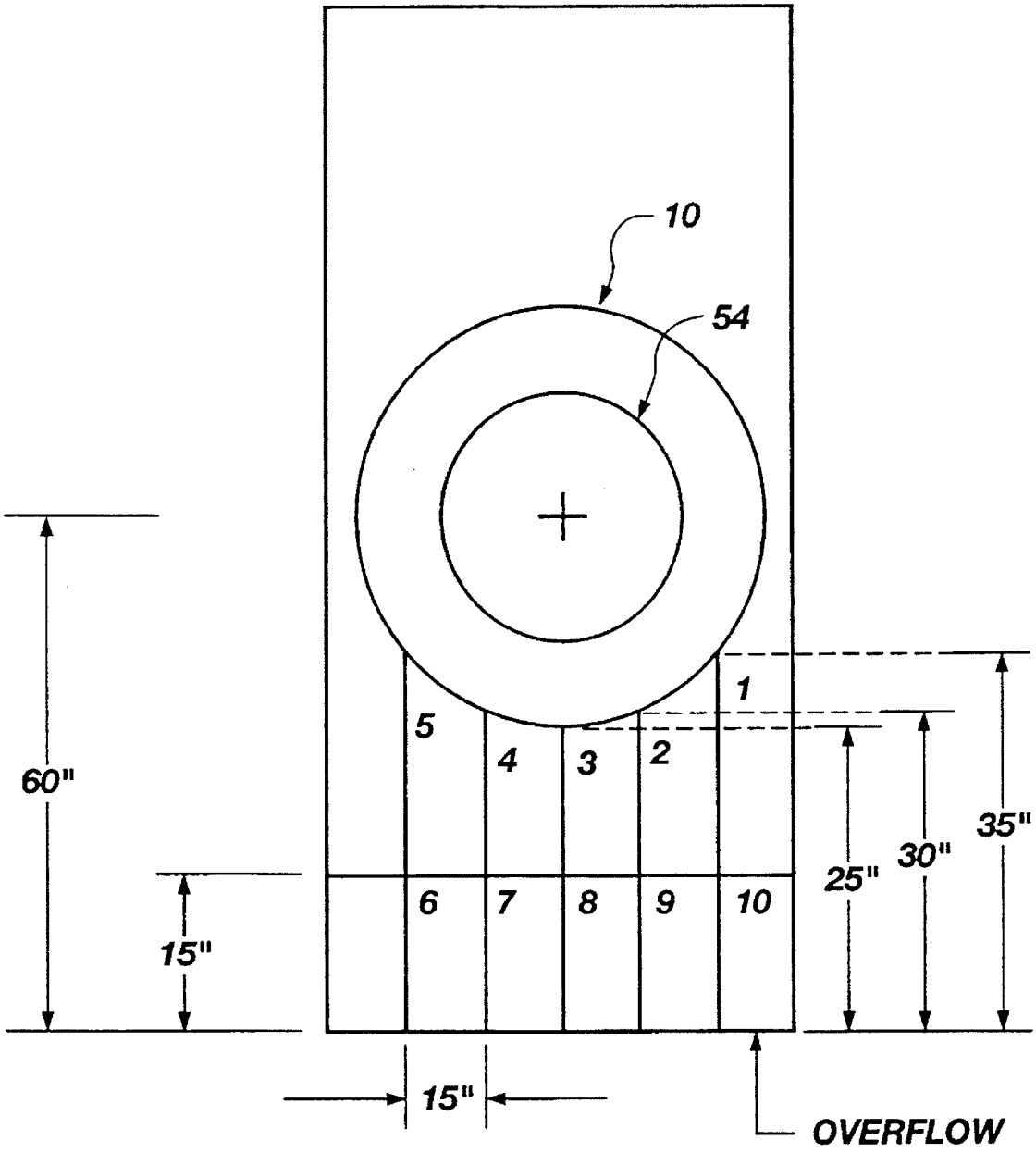
FIG. 4 is a schematic plan view of a flotation cell with a crowder device used for comparative testing.

To illustrate the effectiveness of the crowder device in facilitating movement of the froth to the overflow lip, the area between the standpipe or the crowder device and the launder in the test flotation cells were divided into grid sections as shown in FIGS. 3 and 4. Each grid section in the flotation cell depicted in FIG. 3 measured fifteen inches by fifteen inches. Grid sections 6–10 in the flotation cell depicted in FIG. 4 measured fifteen inches by fifteen inches, while the grid sections 1–5 varied in measurement, as noted in FIG. 4, as a result of the curved line of the crowder device.

Both flotation cells were operated under the conditions described above with the exception that tap water was used as a substitute for influent feed. The experimental evaluations sought to determine liquid surface transport dynamics because both the presence of froth above the liquid surface and the overflow of liquid into the launder influence the surface transport time. Therefore, some tests were run in which a frothing agent (i.e., mono isopropyl biphenol or MIBC) was added to the water in the tank to produce more froth. Other tests were run without a frother being added. Further, some tests were run where the water line in the tank was just below the launder so that no overflow of fluid into the launder was observed. Other tests were run where the water level was high enough to cause overflow of fluid into the launder. Those two test conditions were varied within the test runs so that some tests were conducted with no frother and no overflow of fluid; some tests were conducted with no frother, but with overflow of fluid; some tests were conducted with frother, but no overflow of fluid; and some tests were conducted with frother and with overflow of fluid.

The flotation cells were operated at varying speeds of the rotor to test the effect that the crowder device had on rotor speed. As the flotation cells were operated, a float was placed in one of the ten grid sections at a selected distance from the launder and the time it took for the float to travel from its place of insertion to the launder was recorded. Thus, for example, a float inserted into the froth or fluid in the flotation cell shown in FIG. 3 at number "2" was tested for travel time to the launder and likewise, a float inserted into the froth or fluid in the flotation cell shown in FIG. 4 at number "2" was tested for travel time to the launder. The two times were then compared.

The results of over four hundred "float time" test runs are summarized in TABLE I, below.

TABLE I

| | | | NO CROWDER | | CROWDER | | | | | |
|---|---|---|---|---|---|---|---|---|---|---|
| | | | ROTOR SPEED | | | | | | | |
| | | | 218 RPM | | 218 RPM | | 189 RPM | | 158 RPM | |
| | | | POWER | | | | | | | |
| | | | 20.79 Hp. | | 20.79 Hp. | | 15.34 Hp. | | 9.51 Hp. | |
| FROTHER | O/F | DIST. TO O/F (IN) | AVG. (1) TRAVEL TIME (SEC) | INF. (2) TIME TESTS (%) | AVG. (1) TRAVEL TIME (SEC) | INF. (2) TIME TESTS (%) | AVG. (1) TRAVEL TIME (SEC) | INF. (2) TIME TESTS (%) | AVG. (1) TRAVEL TIME (SEC) | INF. (2) TIME TESTS (%) |
| NO | NO | 15 | 27.340 | ↑↕↓ | 3.3533 | ↑↕↓ | 2.4000 | ↑↕↓ | 4.0133 | ↑↕↓ |
| | | 25.5 | — | | 4.4667 | | 2.03333 | | 2.5000 | |
| | | 30 | 93.258 | 45 | 4.8833 | 0 | 1.8000 | 0 | 2.0833 | 0 |
| | | 35 | — | ↑↕↓ | 4.3333 | ↑↕↓ | 4.6500 | ↑↕↓ | 16.5833 | ↑↕↓ |
| YES | NO | 15 | 97.400 | ↑↕↓ | 17.3533 | ↑↕↓ | 48.9867 | ↑↕↓ | 63.4067 | ↑↕↓ |
| | | 25.5 | — | | 30.2333 | | 87.5333 | | 84.7667 | |
| | | 30 | 90.200 | 60 | 35.4000 | 3.33 | 25.6167 | 26.67 | 43.6833 | 43.33 |
| | | 35 | — | ↑↕↓ | 28.6667 | ↑↕↓ | 82.9000 | ↑↕↓ | 91.8500 | ↑↕↓ |

TABLE I-continued

| | | | NO CROWDER | | CROWDER | | | | | |
|---|---|---|---|---|---|---|---|---|---|---|
| | | | ROTOR SPEED | | | | | | | |
| | | | 218 RPM | | 218 RPM | | 189 RPM | | 158 RPM | |
| | | | POWER | | | | | | | |
| | | | 20.79 Hp. | | 20.79 Hp. | | 15.34 Hp. | | 9.51 Hp. | |
| FROTHER | O/F | DIST. TO O/F (IN) | AVG. (1) TRAVEL TIME (SEC) | INF. (2) TIME TESTS (%) | AVG. (1) TRAVEL TIME (SEC) | INF. (2) TIME TESTS (%) | AVG. (1) TRAVEL TIME (SEC) | INF. (2) TIME TESTS (%) | AVG. (1) TRAVEL TIME (SEC) | INF. (2) TIME TESTS (%) |
| NO | YES | 15 | 50.200 | ↕ | 2.3133 | ↕ | 2.0333 | ↕ | 2.2200 | ↕ |
| | | 25.5 | — | | 5.2000 | | 1.8333 | | 1.5333 | |
| | | 30 | 108.320 | 65 | 2.8333 | 0 | 1.7333 | 0 | 2.0000 | 0 |
| | | 35 | — | ↕ | 3.8333 | ↕ | 6.2500 | ↕ | 8.5833 | ↕ |
| YES | YES | 15 | 23.850 | ↕ | 4.8667 | ↕ | 4.5667 | ↕ | 4.6467 | ↕ |
| | | 25.5 | — | | 10.3000 | | 6.1000 | | 4.8333 | |
| | | 30 | 33.250 | 5 | 8.4167 | 0 | 5.7833 | 0 | 5.6500 | 0 |
| | | 35 | — | ↕ | 7.5333 | ↕ | 8.9667 | ↕ | 6.6667 | ↕ |

(1) AVERAGE FLOAT TRAVEL TIME FROM INSERTION POINT TO O/F WEIR.
(2) PERCENTAGE OF TESTS WHERE THE TEST WAS HALTED @ 120 SEC. . . . THE FLOAT WAS CAUGHT IN A SURFACE EDDY & DID NOT REACH THE O/F WEIR.

As shown in TABLE I, the time that it took a float inserted in the liquid (no frother added) at a distance of thirty inches from the launder (see column 3 of TABLE I) to reach the launder (without overflow of fluid into the launder) in the flotation cell without the crowder device was 93.258 seconds. By comparison, a float inserted in the liquid (no frother added) at thirty inches from the launder in the flotation cell having a crowder device, and operated at 218 rpm (revolutions per minute), averaged 4.8833 seconds of travel time. When the rotor speed was operated at 189 rpm, the average time for the float to travel the thirty inches was 1.8 seconds.

It should be noted that in the time tests run on the two flotation cells, the clock was stopped at 120 seconds if the float did not make it to the launder by the time 120 seconds had lapsed. It was observed that a float would occasionally become caught in a surface eddy and would not reach the launder in any quantifiable time. However, it was also observed between the movement of the floats in the flotation cell without a crowder device and the flotation cell with a crowder device that few surface eddies occurred in the latter flotation cell. More particularly, surface eddies were only observed in the flotation cell with a crowder device when operated with a frother added and no fluid overflow, and even then, surface eddies only occurred 3.33% of the time when the rotor was operated at a speed of 218 rpm as compared to surface eddies occurring 60% of the time in the flotation cell without a crowder device. The data supporting that observation is shown in columns 5, 7, 9 and 11 of TABLE I. Thus, it was demonstrated that the crowder device was beneficial to the operation of a flotation cell by limiting the development of surface eddies.

It can be observed from the test data shown in TABLE I that the froth travel time was significantly decreased in the flotation cell which included the crowder device. It can also be demonstrated from the test results that use of a crowder device enables operation of the flotation cell at reduced rotor speeds, thereby saving energy in operation of the flotation cell.

The flotation cells described herein have been described in terms of metallurgical applications, but the crowder device may be used in any type of application with improved results. Thus, reference herein to specific details of the illustrated embodiments is by way of example and not by way of limitation. It will be apparent to those skilled in the art that many modifications of the basic illustrated embodiment may be made without departing from the spirit and scope of the invention as recited by the claims.

What is claimed is:

1. A froth flotation cell comprising:

a tank having a continuous outer wall, a closed bottom and an upper section;

a motorized rotor positioned within said tank;

an influent feed inlet positioned relative to said tank to introduce influent feed into said tank;

an overflow launder positioned near said upper section of said tank; and a crowder device positioned in said tank and extending at least in part above said overflow launder, said crowder device comprising an upper perimeter edge spaced apart from a lower perimeter edge and a substantially continuous contact surface extending therebetween, said upper perimeter edge being greater in dimension than said lower perimeter edge such that said substantially continuous contact surface is sloped downwardly and inwardly from said upper perimeter edge to said lower perimeter edge at an angle not greater than 45° from a horizontal plane formed through said lower perimeter edge, said overflow launder has an overflow lip and said upper edge is positioned above said overflow lip, the vertical distance between the upper perimeter edge and said overflow lip being about 6% to about 11% of the depth of the tank and the vertical distance between the lower perimeter edge and the overflow lip being between about 5% to about 15% of the depth of said tank.

2. The froth flotation cell of claim 1 wherein said slope of said substantially continuous contact surface is from between about 35° and not greater than about 45°.

3. The froth flotation cell of claim 2 wherein said slope of said substantially continuous contact surface is preferably about 45°.

4. The froth flotation cell of claim 2 wherein said crowder device is vertically adjustable within said tank relative to said overflow launder.

5. The froth flotation cell of claim 4 wherein said upper perimeter edge of said crowder device is adjustable relative to said lower perimeter edge to selectively adjust the angle of slope of said substantially continuous contact surface.

6. The froth flotation cell of claim 2 wherein said upper perimeter edge of said crowder device is adjustable relative to said lower perimeter edge to selectively adjust the angle of slope of said substantially continuous contact surface.

7. The froth flotation cell of claim 2 wherein said crowder device is configured as a truncated cone.

8. The froth flotation cell of claim 2 wherein said substantially continuous contact surface of said crowder device is comprised of at least three contiguous sides.

9. The froth flotation cell of claim 8 wherein said substantially continuous contact surface of said crowder device is comprised of four contiguous sides, each said side being of approximately equal length.

10. The froth flotation cell of claim 9 wherein said substantially continuous contact surface of said crowder device is comprised of four contiguous sides the two opposing sides of which are approximately equal in length.

* * * * *

UNITED STATES PATENT AND TRADEMARK OFFICE

CERTIFICATE OF CORRECTION

PATENT NO. : 5,611,917

DATED : March 18, 1997

INVENTOR(S) : Vernon R. Degner

It is certified that error appears in the above-identified patent and that said Letters Patent is hereby corrected as shown below:

In Column 5, line 39, after "lip" insert --30--;

In Column 6, line 44, delete the comma after "processed";

In Column 7, line 1, change "54" to --64--;

In Column 7, line 12, insert a comma after "stationary";

In Column 7, line 23, insert a comma after "capacity";

In Column 7, line 27, change "(60)" to --60--;

In Column 7, line 29, change "(28)" to --28--;

In Column 7, line 37, change "were" to --was--;

In Column 8, line 33, insert a comma after "and";

In column 11, line 6, delete "about".

UNITED STATES PATENT AND TRADEMARK OFFICE

CERTIFICATE OF CORRECTION

PATENT NO. : 5,622,917

DATED : March 18, 1997

INVENTOR(S) : Vernon R. Degner

It is certified that error appears in the above-identified patent and that said Letters Patent is hereby corrected as shown below:

In the Abstract, line 17, change "traps" to --trap--;

In the Abstract, line 17, change"extends" to --extend--;

In Column 1, line 26, after "volume" insert --in--;

In Column 1, line 50, change "is" to --are--;

In Column 3, line 24, change "tie" to --be--;

In Column 3, line 54, change "Mode" to --mode--;

In Column 4, line 60, change "50" to --54--;

In Column 5, line 12, change "position" to --positioned--;

In Column 5, line 23, insert a comma after "embodiment";

In Column 5, line 24, after "58" insert --at the--;

Signed and Sealed this

Twenty-sixth Day of May, 1998

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,611,917
DATED : March 18, 1997
INVENTOR(S) : Vernon R. Degner

It is certified that error appears in the above-identified patent and that said Letters Patent is hereby corrected as shown below:

In the Abstract, line 17, change "traps" to --trap--;

In the Abstract, line 17, change"extends" to --extend--;

In Column 1, line 26, after "volume" insert --in--;

In Column 1, line 50, change "is" to --are--;

In Column 3, line 24, change "tie" to --be--;

In Column 3, line 54, change "Mode" to --mode--;

In Column 4, line 60, change "50" to --54--;

In Column 5, line 12, change "position" to --positioned--;

In Column 5, line 23, insert a comma after "embodiment";

In Column 5, line 24, after "58" insert --at the--;

In Column 5, line 39, after "lip" insert --30--;

UNITED STATES PATENT AND TRADEMARK OFFICE

CERTIFICATE OF CORRECTION

PATENT NO. : 5,611,917

DATED : March 18, 1997

INVENTOR(S) : Vernon R. Degner

It is certified that error appears in the above-identified patent and that said Letters Patent is hereby corrected as shown below:

In Column 6, line 44, delete the comma after "processed";

In Column 7, line 1, change "54" to --64--;

In Column 7, line 12, insert a comma after "stationary";

In Column 7, line 23, insert a comma after "capacity";

In Column 7, line 27, change "(60)" to --60--;

In Column 7, line 29, change "(28)" to --28--;

In Column 7, line 37, change "were" to --was--;

In Column 8, line 33, insert a comma after "and";

In Column 11, line 6, delete "about".

This certificate supersedes Certificate of Correction issued May 26, 1998.

Signed and Sealed this

Thirteenth Day of October 1998

*Attest:*

Bruce Lehman

BRUCE LEHMAN

*Attesting Officer*

*Commissioner of Patents and Trademarks*